US009201345B2

(12) United States Patent
Uchitani et al.

(10) Patent No.: US 9,201,345 B2
(45) Date of Patent: Dec. 1, 2015

(54) IMAGE-FORMING APPARATUS, TONER CONTAINER AND TONER CONTAINER INSTALLATION STRUCTURE

(75) Inventors: Takeshi Uchitani, Yokohama (JP); Kunihiro Ohyama, Fuchu (JP); Yasufumi Takahashi, Machida (JP); Masayuki Yamane, Yokohama (JP)

(73) Assignee: RICOH COMPANY, LTD., Tokyo (JP)

( * ) Notice: Subject to any disclaimer, the term of this patent is extended or adjusted under 35 U.S.C. 154(b) by 524 days.

(21) Appl. No.: 13/413,116

(22) Filed: Mar. 6, 2012

(65) Prior Publication Data

US 2012/0230735 A1 Sep. 13, 2012

(30) Foreign Application Priority Data

Mar. 8, 2011 (JP) ..... 2011-050075
Dec. 2, 2011 (JP) ..... 2011-264251

(51) Int. Cl.
*G03G 15/08* (2006.01)

(52) U.S. Cl.
CPC ..... *G03G 15/0872* (2013.01); *G03G 15/0863* (2013.01)

(58) Field of Classification Search
CPC ..... G03G 15/0872; G03G 15/0863; G03G 21/1867
USPC ..... 399/12, 13, 90
See application file for complete search history.

(56) References Cited

U.S. PATENT DOCUMENTS 5,944,563 A * 8/1999 Nagafuji
5,963,759 A 10/1999 Kojima et al.
6,665,508 B2 12/2003 Sudo et al.
7,277,664 B2 10/2007 Katsuyama et al.
7,407,394 B1 * 8/2008 Parish et al.
7,425,151 B2 * 9/2008 Baba et al.
7,447,469 B2 11/2008 Uchiyama et al.
7,822,371 B2 10/2010 Taguchi et al.
2003/0215261 A1 * 11/2003 Karakama et al.
2006/0133831 A1 * 6/2006 Rommelmann et al. ..... 399/12
2007/0086809 A1 * 4/2007 Yamane (Continued)

FOREIGN PATENT DOCUMENTS

JP 8-255606 10/1996
JP 10-49032 2/1998

(Continued)

OTHER PUBLICATIONS

Office Action issued Sep. 29, 2015 in Japanese Patent Application No. 2011-264251.

*Primary Examiner* — Walter L Lindsay, Jr.
*Assistant Examiner* — Milton Gonzalez
(74) *Attorney, Agent, or Firm* — Oblon, McClelland, Maier & Neustadt, L.L.P.

(57) ABSTRACT

An image-forming apparatus and toner container installation structure used in the image-forming apparatus, includes: a toner container with a toner container body, being attached to a fitting section in a body of the image-forming apparatus in a detachable manner. There is a latent image-bearing member, a developing unit, for developing the latent image with a toner supplied from the toner container body; an ID chip provided in the toner container, having a plurality of through-hole electrodes; and a substrate provided in the fitting section, having a plurality of pin electrodes. The pin electrodes are fitted into the through-hole electrodes when the toner container is attached to the fitting section.

19 Claims, 10 Drawing Sheets

(56) References Cited

U.S. PATENT DOCUMENTS

| | | | |
|---|---|---|---|
| 2007/0230999 | A1* | 10/2007 | Shimomura |
| 2008/0102674 | A1* | 5/2008 | Dawson et al. |
| 2010/0226690 | A1 | 9/2010 | Kadota et al. |

FOREIGN PATENT DOCUMENTS

| | | | |
|---|---|---|---|
| JP | 10-135589 | | 5/1998 |
| JP | 11-348375 | | 12/1999 |
| JP | 2002-196629 | | 7/2002 |
| JP | 2003-257522 | | 9/2003 |
| JP | 2006058743 | A * | 3/2006 |
| JP | 2006-209060 | | 8/2006 |
| JP | 2007-10774 | | 1/2007 |
| JP | 2008-20605 | | 1/2008 |
| JP | 2009-54627 | | 3/2009 |
| JP | 2009-69417 | | 4/2009 |
| JP | 2009-294477 | | 12/2009 |
| WO | WO 2011/155642 | A1 | 12/2011 |

* cited by examiner

RELATED ART

RELATED ART

IMAGE-FORMING APPARATUS, TONER CONTAINER AND TONER CONTAINER INSTALLATION STRUCTURE

CROSS-REFERENCE TO RELATED APPLICATIONS

Priority is claimed on Japanese Patent Applications No. 2011-50075, filed on Mar. 8, 2011 and No. 2011-264251, filed on Dec. 2, 2011, the content of which is incorporated herein by reference.

BACKGROUND OF THE INVENTION

1. Field of the Invention

The present invention relates to an image-forming apparatus, a toner container and a toner container installation structure used in image-forming apparatuses that have electrophotographic systems, such as copying machines, printers, facsimile machines, combinations thereof, and so on.

2. Description of Related Art

Conventionally, in image-forming apparatuses in electrophotographic systems, such as the copying machines, printers, facsimile machines, and so on, which have latent image-bearing members such as photoreceptor drums and photoreceptor belts and so on, the image-forming apparatuses are configured to irradiate laser light on the surfaces of latent image-bearing members to form image information as latent images, and to deposit toners to the latent images to be developed (visualized) by developing apparatuses.

Toner is consumed in the developing machines, so that toner cartridges with toner containers, i.e. toner cartridges and toner bottles, are provided in the image-forming apparatuses in a detachable manner for supplying toners to the developing machines. An ID chip substrate (hereinafter referred to as "ID chip") is attached to a lateral face of the toner container, and the ID chip has a memory for memorizing information such as a toner amount remaining, a compatibility with the body of the image-forming apparatus, a serial number, and so on.

The ID chip as described above communicates with the body of the image-forming apparatus when the toner container is attached to the body of the image-forming apparatus. As the ID chip, there is a contact-type one that contacts electrodes of the ID chip to pin electrodes on connectors of the body of the image-forming apparatus (for example, see Patent literature 1: JPA2009-69417). There is also a noncontact-type one that carries out communication between the ID chip and the body of the image-forming apparatus via an antenna (for example, see Patent literature 2: JPAH11-348375). In addition, there are also other types of ID chip.

Although there are advantages and disadvantages to both the contact-type and noncontact type ID chip, it is more advantageous to set the contact-type one not to have any antenna in order to downsize the image-forming apparatus and save cost.

FIGS. 14 and 15 show a substrate 1 in the contact-type. FIG. 14 shows a plan view of the substrate on the side of the body of the image-forming apparatus. FIG. 15 is a perspective view of the substrate shown in FIG. 14.

As shown in FIGS. 14 and 15, a connector 2 in a block shape is provided on the ID chip substrate 1, and four pin electrodes 3-6 are provided in an end surface 2A of the connector 2. Each of the pin electrodes 3-6 is formed with the central part thinner toward both ends, and the central part is bended arc-like in such a way that the bended part projects away from the end surface 2A of the connector 2. As shown in FIG. 16, the projected thin parts contact four electrodes 8-11, respectively, which are provided in an ID chip 7 on the side of the toner cartridge.

Moreover, in FIG. 14, a distance between the central axes of the pin electrodes 3 and 4, a distance between the central axes of the pin electrodes 4 and 5, and a distance between the central axes of the pin electrodes 5 and 6 are referred to as "pin-pitch P1", respectively. In FIG. 14, the pin-pitch P1 between the central axes of the pin electrodes 4 and 5 is only shown.

SUMMARY OF THE INVENTION

In recent years, due to growing market needs, new image-forming apparatuses have been developed to save space and cost. In order to save space and cost, it is preferable to reduce the pin-pitch P1 and the areas of the electrodes 8-11 on the ID chip 7.

However, if the pin-pitches P1, P1, P1 and the areas of the electrodes 8-11 on the ID chip 7 are reduced, it is required to perform highly accurate positioning and to attach the toner container to the body of the image-forming apparatus more accurately than before. One configuration proposed in Patent literature 1 only supports a member which fixes the ID chip, but it is hard to perform highly accurate positioning of the container.

An object of the present invention is to provide an image-forming apparatus and installation structure for a toner container used in the image-forming apparatuses in order to achieve more highly accurate positioning of the toner container even if the pin-pitch is narrowed down and the area of the electrodes on the ID chip is reduced.

In order to achieve the object, the present invention has a feature in which holes for positioning on the toner container are integrated with electrodes for communication on the ID chip.

Namely, an image-forming apparatus according to the present invention includes: a toner container, having a toner container body, being attached to a fitting section in a body of the image-forming apparatus in a detachable manner; a latent image-bearing member, being formed with a latent image thereon; a developing unit, for developing the latent image with a toner supplied from the toner container body, an ID chip provided in the toner container, having a plurality of through-hole electrodes; and a substrate provided in the fitting section, having a plurality of pin electrodes, wherein the pin electrodes are fitted into the through-hole electrodes when the toner container is attached to the fitting section.

An installation structure for a toner container includes: a toner container, having a toner container body, being attached to a fitting section in a body of an image-forming apparatus in a detachable manner; an ID chip provided in the toner container, having a plurality of through-hole electrodes; and a substrate provided in the fitting section, having a plurality of pin electrodes, wherein the pin electrodes are fitted into the through-hole electrodes when the toner container is attached to the fitting section.

A toner container includes: a toner container body containing toner, and an ID chip with a plurality of through-hole electrodes, wherein the through-hole electrodes are fitted into by pin electrodes provided in an image-forming apparatus when the toner container is attached to the image-forming apparatus.

DETAILED DESCRIPTION OF THE PREFERRED EMBODIMENTS

The embodiments according to the present invention will be explained below by referring to the figures.

Embodiment 1

Figure 1:
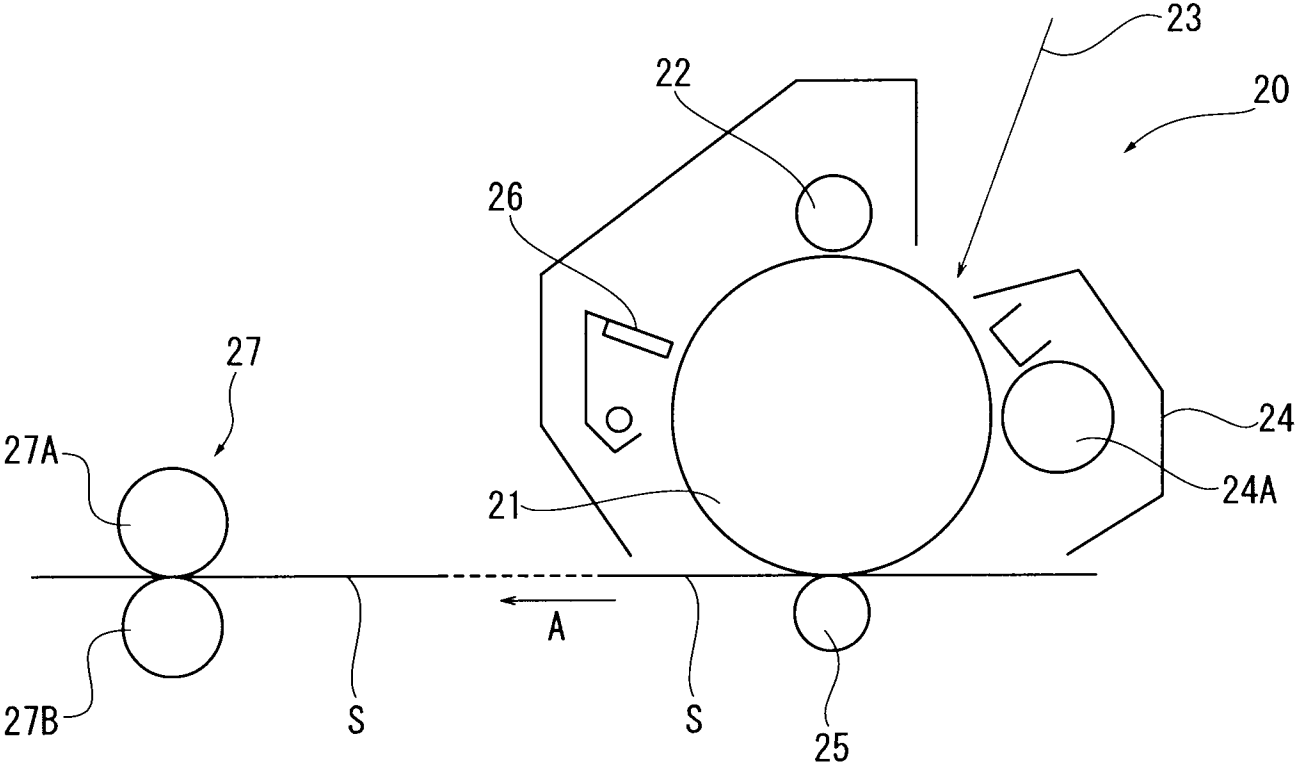
FIG. 1 shows a schematic view showing an image-forming apparatus according to the present invention.

FIG. 1 shows a schematic view showing an image-forming apparatus 20 according to the present invention. A photoreceptor drum 21 as a latent image-bearing member is provided in the image-forming apparatus 20.

A charge roller 22 adjacent to or contacted by the photoreceptor drum 21 to charge the photoreceptor drum 21, an exposure device (not shown in the figures) to irradiate laser light 23 to the charged photoreceptor drum 21 to form an electrostatic latent image thereon, a developing apparatus 24 as a developing unit to deposit toner to the electrostatic latent image on the photoreceptor drum 21 to develop the latent image to be a toner image, a transfer roller 25 to transfer the toner image on the photoreceptor drum 21 to a recording medium S, and a cleaning device 26 to clean the photoreceptor drum 21 after the transferring, are provided around the photoreceptor drum 21.

A developing roller 24A is provided in the developing apparatus 24 to supply toner between the photoreceptor drum 21 and the developing roller 24A.

A fixing device 27 is provided on the downstream side of the photoreceptor drum 21 along with the conveyance direction A of the recording medium S (see FIG. 1).

The fixing device 27 is equipped with a fixing roller 27A and fuser roller 27B. By passing the recording medium S between the fixing roller 27A and the fuser roller 27B, the toner image that has been transferred by the transfer roller 25 onto the recording medium S is fixed and fused thereon.

Figure 2:
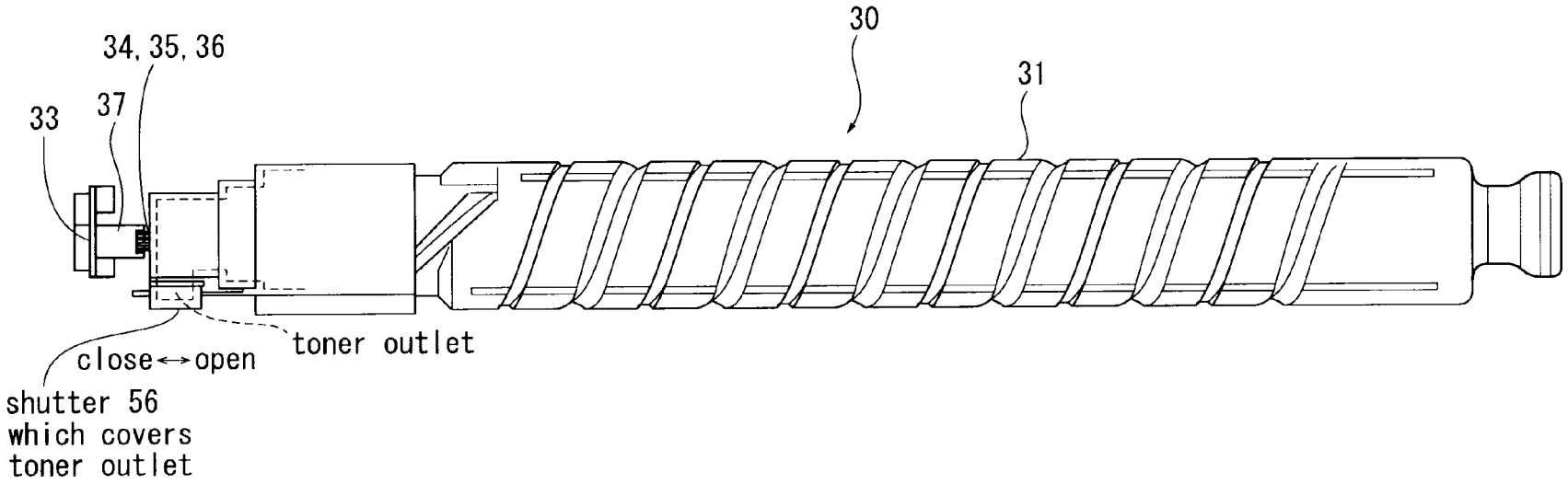
FIG. 2 shows a relationship of a toner cartridge and a substrate to be attached by the toner cartridge.

FIG. 2 shows a relationship of a toner cartridge 30 as a toner container and a substrate 33 to be attached by the toner cartridge 30. The toner cartridge 30 is for supplying the toner to the developing apparatus 24 (see FIG. 1).

The toner cartridge 30 is equipped with a toner bottle 31 as a container body containing toner. An ID chip 32 (see FIG. 5) is provided in one of lateral surfaces (an end face on the left side in FIG. 2) of the toner cartridge 30.

The substrate 33 to be attached with the toner cartridge 30 is mounted on the image-forming apparatus 20 (see FIG. 1), and a connector 37 with three pin electrodes 34-36 is provided in the substrate 33.

The toner cartridge 30 is attached to the substrate 33 in a detachable manner. The pin electrodes 34-36 and the connector 37 will be discussed in detail below. The substrate 33 constitutes a fitting section for the cartridge 30.

Figure 3:
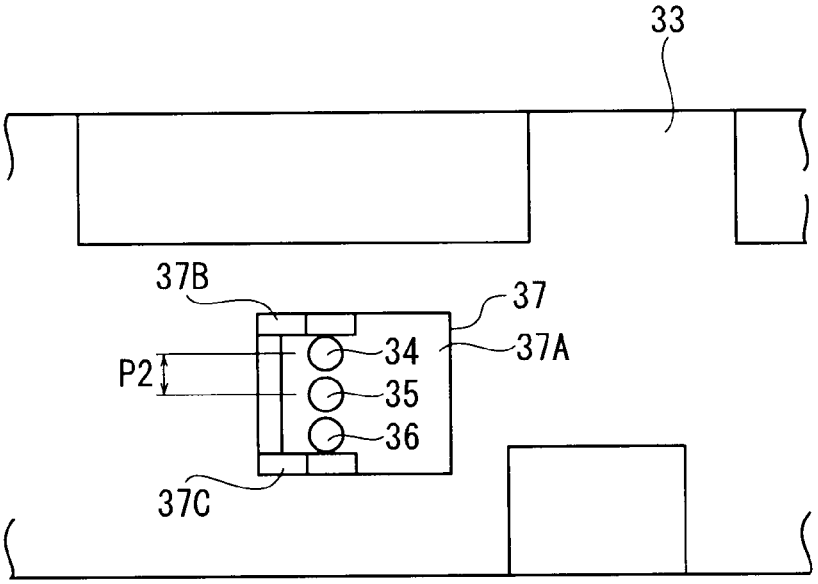
FIG. 3 shows a plan view of the substrate on the side of the body of the image-forming apparatus in Embodiment 1 according to the present invention.
Figure 4:
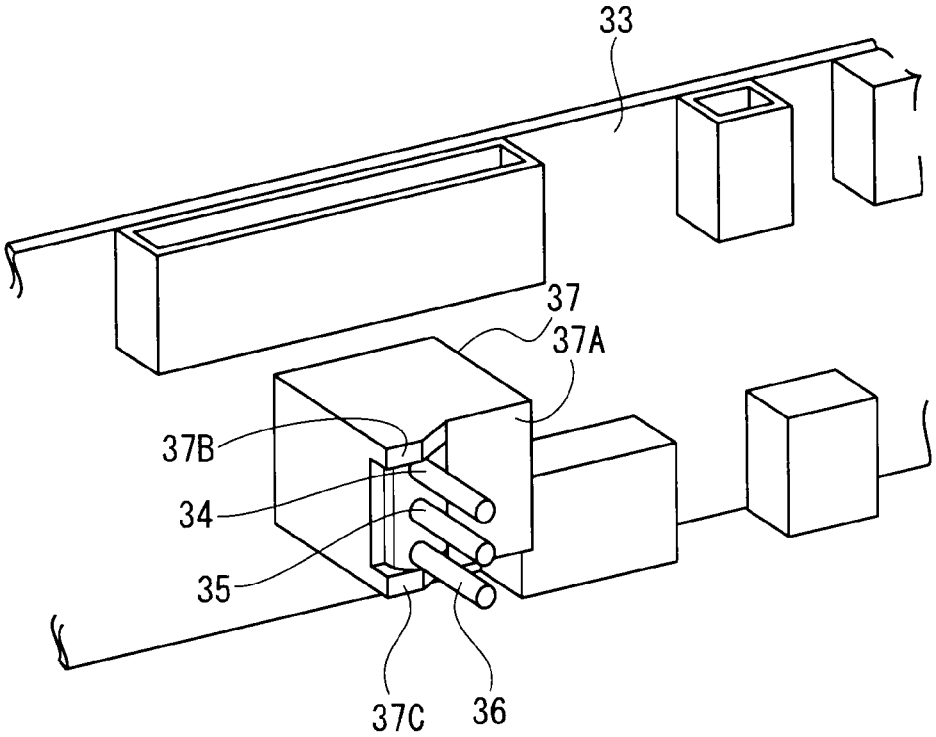
FIG. 4 shows a perspective view of the substrate shown in FIG. 3.

FIGS. 3 and 4 show the technical feature of Embodiment 1, FIG. 3 shows a plan view of the substrate 33 on the side of the body of the image-forming apparatus 20, and FIG. 3 is a perspective view of the substrate 33 shown in FIG. 2.

As shown in FIGS. 3 and 4, the connector 37 in a block shape is provided in the substrate 33, and convex portions 37B, 37C are formed on the top and bottom ends of one side (the left side in FIGS. 3 and 4) of the top surface 37A in the connector 37, respectively.

The three pin electrodes 34-36 are attached in between the convex portions 37B and 37C on the top surface 37A of the connector 37. Each of the pin electrodes 34-36 is formed of a pillar and the pin electrodes 34-36 are arrayed vertically. Each of the pin electrodes 34-36 is made of a conductive material and their outer diameters are all set to be the same.

Moreover, in FIG. 3, a distance of the central axes of the pin electrodes 34 and 35 and a distance of the central axes of the pin electrodes 35 and 36 are referred to as "pin-pitch P2".

In FIG. 3, only one of the pin-pitches P2 of the central axes of the pin electrodes 34 and 35 is shown.

Figure 5:
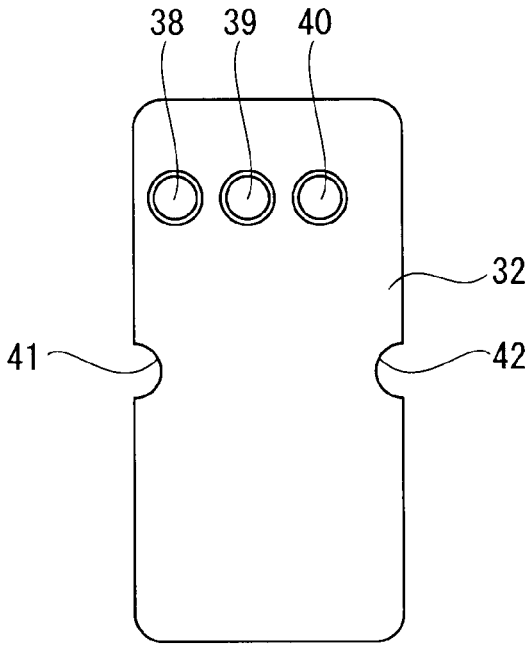
FIG. 5 shows a plan view of the ID chip.

FIG. 5 is a plan view of the ID chip 32 that is provided in the lateral surface (an end face on the left side in FIG. 2) of the toner cartridge 30. This ID chip 32 is formed of a rectangle plate, and three through-hole electrodes 38-40 composed of penetrating holes are formed in line on one side (upper side in FIG. 5) of the ID chip 32.

The inner periphery portions of these through-hole electrodes 38-40 are made of a conductive material and their inner diameters are all set to be the same. These inner diameters are all set to be slightly smaller than the outer diameters of the pin electrodes 34-36.

Concave portions 41, 42 as positioning sections for the ID chip 32 are formed in the right and left sides of the central part of the ID chip 32 for the positioning of the ID chip 32. By using these concave portions 41, 42, it is possible to position the ID chip 32 easily when attaching the ID chip to the toner cartridge 30. Moreover, the concave portions 41, 42 are formed in a semicircular shape.

Next, operations according to Embodiment 1 will be explained below.

When attaching the toner cartridge 30 to the image-forming apparatus 20, the pin electrodes 34-36, which are provided in the connector 37 of the substrate 33 on the side of the body of the image-forming apparatus 20, are fitted into the through-hole electrodes 38-40, which are formed in the ID chip 32 on the side of the toner cartridge 30.

The inner periphery portions of these through-hole electrodes 38-40 are made of a conductive material, and the pin electrodes 34-36 are also made of a conductive material, so that the through-hole electrodes 38-40 and the pin electrodes 34-36 are electrically connected to each other one-on-one by fitting the pin electrodes 34-36 into the though-hole electrodes 38-40, respectively.

Therefore, it is possible for the ID chip 32 of the toner cartridge 30 to communicate with the image-forming apparatus 20.

When attaching the toner cartridge 30 to the image-forming apparatus 20, the pin electrodes 34-36 are fitted into the through-hole electrodes 38-40 respectively, so that it is possible to perform the positioning of the toner cartridge 30 more easily and with higher accuracy.

According to Embodiment 1, it is possible to downsize the toner cartridge 30 much more by narrowing down the distances of the pin electrodes 34-36 (pin-pitch P2), which leads to downsizing of the image-forming apparatus 20.

It is acceptable to constitute the pin electrodes 34-36 as extensible ones to extend and fit into the through-hole electrodes 38-40 when attaching the toner cartridge 30 to the image-forming apparatus 20.

It is also acceptable to provide the pin electrodes 34-36 on the lateral surface of the connector 37, and provide the ID chip 32 on the lateral surface of the toner cartridge 30.

When there is variation in the dimension of the pin electrodes 34-36 at the time of manufacture, the outer periphery surfaces of the pin electrodes 34-36 contact and rub the inner periphery portions of the through-hole electrodes 38-40 when the pin electrodes 34-36 are fitted into the through-hole electrodes 38-40 in setting the ID chip 32 to the connector 37.

To prevent such rubbing, it is necessary to manufacture the connector 37 and so on so as not to be subject to variation in the dimension of the pin electrodes 34-36 by controlling the distances of the pin electrodes 34-35 and 35-36 (namely, pin-pitch P2 shown in FIG. 3) properly.

As for a slight mismatch in the pin-pitch P2, it is preferable to set the lengths of the pin electrodes 34-36 long enough and to set the outer diameters of the pin electrodes 34-36 small enough for the pin electrodes 34-36 to deform elastically (namely, bend in any direction) and fit into the through-hole electrodes 38-40 easily when the pin electrodes 34-36 are fitted into the through-hole electrodes 38-40.

Embodiment 2

Figure 6:
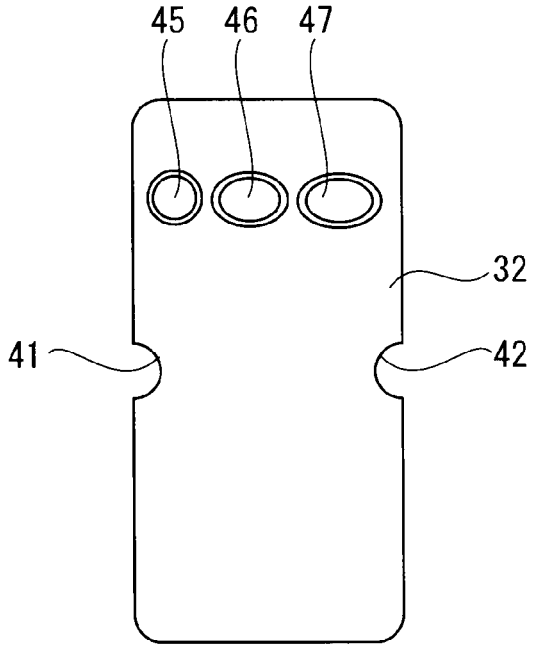
FIG. 6 shows a plan view of an ID chip according to Embodiment 2.
Figure 7:
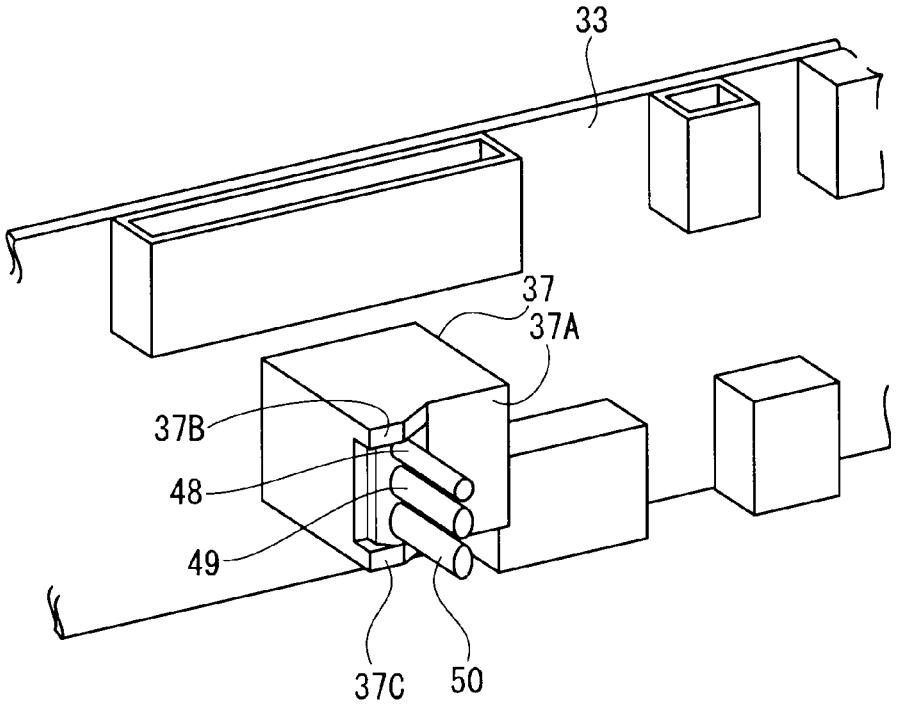
FIG. 7 shows a perspective view of a substrate according to Embodiment 2.

FIGS. 6 and 7 show the present Embodiment 2. FIG. 6 is a plan view of the ID chip 32, and FIG. 7 is a perspective view of the substrate 33.

In Embodiment 2, as shown in FIG. 6, a through-hole electrode 45 is formed with its cross-section surface being a true circle shape, but the other through-hole electrodes 46, 47 are formed with its cross-section surface being an oval shape in the ID chip 32. The same as in Embodiment 1, the concave portions 41, 42 are formed in the right and left sides of the central part of the ID chip 32.

Pin electrodes 48-50 are provided in the substrate 33 on the side of the image-forming apparatus 20, as shown in FIG. 7. The cross-sectional surface of the pin electrode 48 is formed of a true circle in accordance with the through-hole electrode 45, but the cross-sectional surfaces of the other pin electrodes 49, 50 are formed in an oval shape in accordance with the through-hole electrodes 46, 47.

The pin electrodes 48-50 are fitted into the through-hole electrodes 45-47, respectively, in attaching the toner cartridge 30 to the substrate 33.

According to Embodiment 2, if the toner cartridge 30 has the left and right sides reversed (in a reversed condition, for example, by the toner cartridge 30 in FIG. 1 being half-turned in a clockwise rotation direction around the central axis of the toner cartridge 30), it is not possible to fit the pin electrodes 48-50 into the through-hole electrodes 47-45, so that it is possible for a user to recognize this immediately.

It is possible to perform the positioning of the toner cartridge 30 with higher accuracy.

When there is variation in the dimension of the pin electrodes 48-50 at the time of manufacture, the outer periphery surfaces of the pin electrodes 48-50 contact and rub the inner periphery portions of the through-hole electrodes 45-47 when the pin electrodes 48-50 of the connector 37 are fitted into the through-hole electrodes 45-47 of the ID chip 32 in setting the ID chip 32 to the connector 37.

To prevent such rubbing, it is necessary to manufacture the connector 37 and so on so as not to be subject to variation in the dimension of the pin electrodes 48-50 by controlling the distances of the pin electrodes 48-49 and 49-50 (namely pin-pitch) properly.

As for a slight mismatch in the pin-pitch, it is preferable to set the lengths of the pin electrodes 48-50 long enough and to set the outer diameters of the pin electrodes 48-50 small enough for the pin electrodes 48-50 to deform elastically (namely, bend in any direction) and fit into the through-hole electrodes 45-47 easily when the pin electrodes 48-50 are fitted into the through-hole electrodes 45-47.

Embodiment 3

Figure 8:
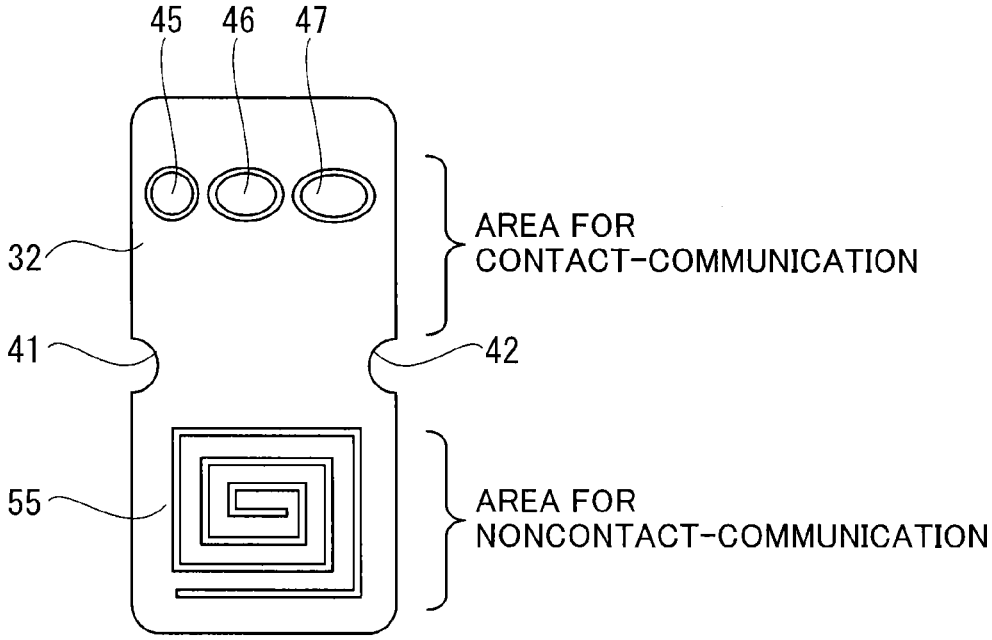
FIG. 8 shows a plan view of an ID chip according to Embodiment 3.

FIG. 8 shows Embodiment 3. In Embodiment 3, a noncontact-type communication unit 55 is provided in the ID chip 32.

With this constitution, it is possible to carry out a noncontact communication using the noncontact-type communication unit 55, and a contact-type communication through the electrodes 45-47 and the pin electrodes 48-50 at the same time; namely, a hybrid-type communication is available.

According to Embodiment 3, with the noncontact-type and contact-type communication units (this contact-type communication unit represents the pin electrodes and the through-hole electrodes and so on in the embodiments), it is possible to carry out communication inside of the body of the image-forming apparatus 20 at less cost by the contact-type communication.

It is also possible to carry out a noncontact type communication easily in a case of collecting information of the ID chip 32 from the toner cartridge 30 at the time of manufacture of a new toner cartridge 30 or recovery of an old toner cartridge 30.

The same as in Embodiments 1 and 2, to prevent rubbing between the pin electrodes 48-50 of the connector 37 and the through-hole electrodes 45-47 of the ID chip 32 in Embodiment 3, it is necessary to manufacture the connector 37 and so on by controlling the distances of the pin electrodes 48-49 and 49-50 (namely pin-pitch) properly.

As for a slight mismatch in the pin-pitch, it is preferable to set the lengths of the pin electrodes 48-50 long enough and to set the outer diameters of the pin electrodes 48-50 small enough, as described in the embodiments above.

Moreover, in Embodiment 3, it is acceptable to use the pin electrodes 34-36 with all cross-sectional surfaces a true circle, as shown in FIG. 4, instead of the pin electrodes 48-50 and use the through-hole electrodes 38-40 with all cross-sectional surfaces a true circle, as shown in FIG. 5, instead of the through-hole electrodes 45-47.

Embodiment 4

Figure 9:
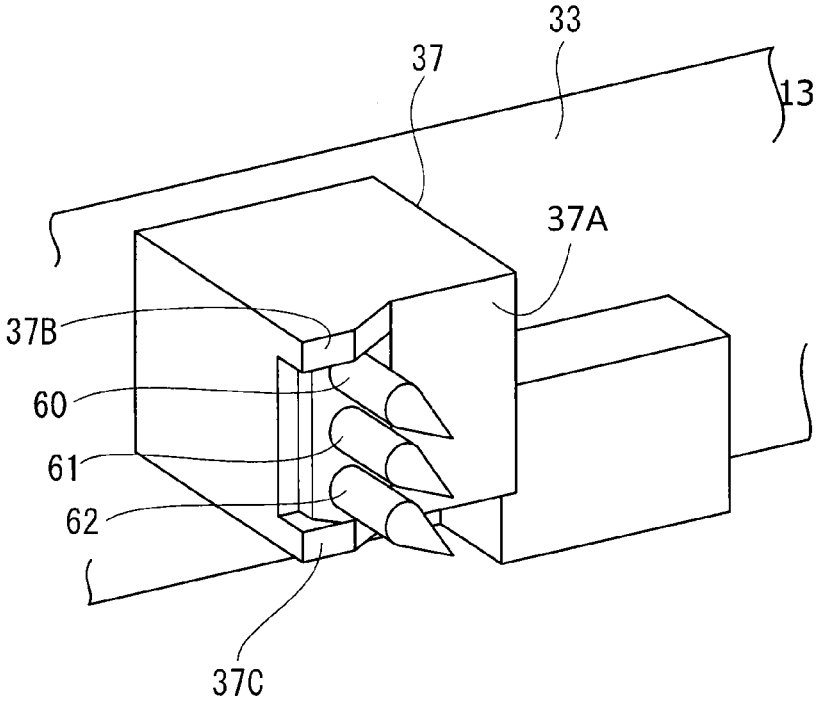
FIG. 9 shows a perspective view of pin electrodes around a connector according to Embodiment 4.

FIG. 9 shows Embodiment 4. In Embodiment 4, pin electrodes 60-62 in a pillar shape are provided in the connector 37 of the substrate 33, the edge portions of the pin electrodes 60-62 being tapered.

According to Embodiment 4, it is possible for a user easily to fit the pin electrodes 60-62 into the through-hole electrodes 38-40 (see FIG. 5), respectively.

The same as in Embodiments 1-3, to prevent rubbing between the pin electrodes 60-62 of the connector 37 and the through-hole electrodes 38-40 of the ID chip 32 in Embodiment 4, it is necessary to manufacture the connector 37 and so on by controlling the distances of the pin electrodes 60-61 and 61-62 (namely pin-pitch) properly.

As for a slight mismatch in the pin-pitch, it is preferable to set the lengths of the pin electrodes 60-62 long enough and to set the outer diameters of the pin electrodes 60-62 small enough, as described in the embodiments above.

Moreover, it is also acceptable in Embodiment 4 to use one or two of pin electrodes with oval cross-sectional surface(s) instead of one or two of the pin electrodes 60-62.

Correspondingly, it is acceptable to use one or two of through-hole electrodes with oval cross-sectional surface(s) instead of one or two of the through-hole electrodes 38-40.

Embodiment 5

Figure 10:
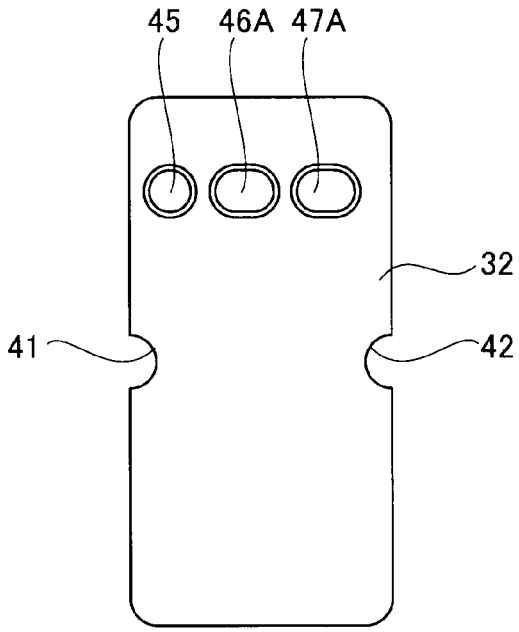
FIG. 10 shows a plan view of an ID chip according to Embodiment 5.

FIG. 10 is a plan view of the ID chip 32 according to Embodiment 5. In Embodiment 5, a through-hole electrode 45 with its cross-sectional surface a true circle and through-hole electrodes 46A, 47A with their cross-sectional surfaces elongated are provided on an upper section of the ID chip 32.

As in each of the embodiments above, the concave portions 41, 42 are formed in the right and left sides of the central part of the ID chip 32. The pin electrodes 34-36 are fitted into the through-hole electrodes 45, 46A and 47A shown in FIGS. 3 and 4 in Embodiment 1.

The through-hole electrodes 46A and 47A with elongated cross-sectional surfaces are different from the ones with oval cross-sectional surfaces in the embodiments above. The inner periphery surfaces on the upside and downside of each of the through-hole electrodes 46A and 47A are parallel. An elongated shape like this is called a depressed orbicular.

Pin electrodes 34-36 from mass production often show variations in dimension; namely, the two pin-pitches between the electrodes 34-36 are slightly different to one another. According to the present embodiment, even with such a difference, the ID chip 32 is positioned by fitting the through-hole electrode 45 and the pin electrode 34 to each other.

The dimensional error is absorbed by fitting the through-hole electrodes 46A, 47A and the pin electrodes 35, 36 to each other, respectively. Therefore, it is possible for a user to fit the pin electrodes 34-36 into the through-hole electrodes 45, 46A, 47A, respectively, without any problem and it is possible to prevent the pin electrodes 34-36 and the ID chip 32 from breaking.

It is also acceptable to apply the technical feature in Embodiment 5 to the ID chip 32 with the noncontact-type communication unit 55 in Embodiment 3, and also to apply the technical feature to the ID chip 32 with the edge portions of the pin electrodes 60-62 tapered in Embodiment 4.

Embodiment 6

Figure 11:
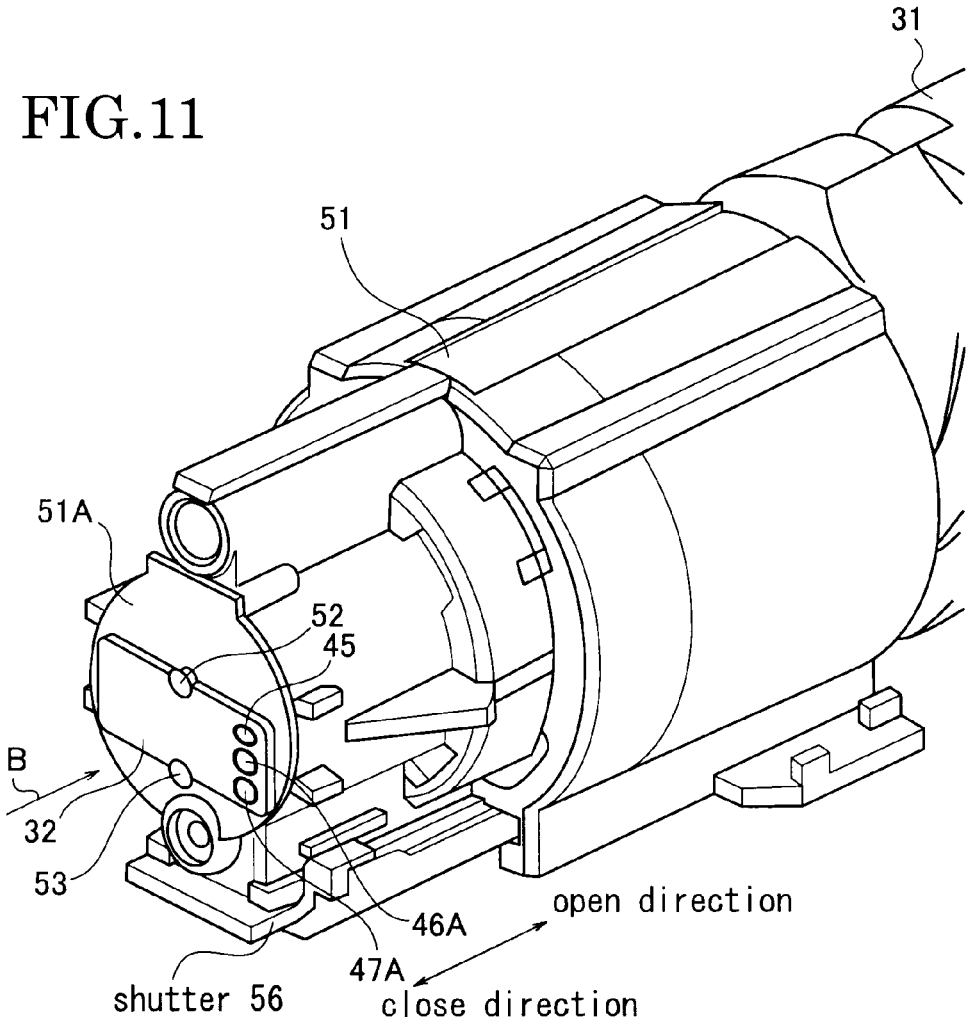
FIG. 11 is a perspective view showing an ID chip attached to the tip of the bottle cap of a toner cartridge according to Embodiment 6.
Figure 12A:
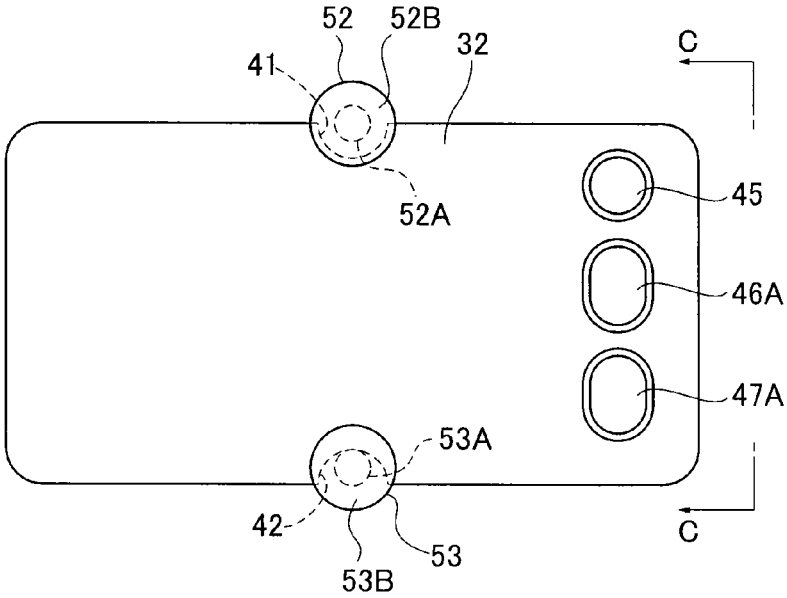
FIG. 12A shows the tip of the bottle cap of the toner cartridge as viewed from the direction of B in FIG. 11.
Figure 12B:
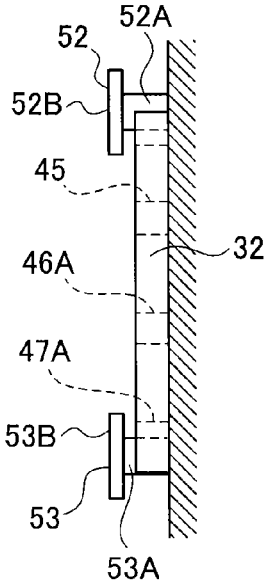
FIG. 12B shows a cross-sectional view of the tip of the bottle cap of the toner cartridge along the line C-C.

FIGS. 11, 12A and 12B show Embodiment 6. FIG. 11 is a perspective view of a condition in which the ID chip 32 in Embodiment 5 is attached to the tip of the bottle cap 51 of a toner cartridge. FIG. 12A shows a view of the tip in the direction of B in FIG. 11. FIG. 12B shows a cross-sectional view of the tip of the bottle cap 51 along the line C-C in FIG. 12A. The bottle cap has a shutter 56 to open/close the toner outlet, which is arranged bottom of the cap 51.

The ID chip 32 is provided in the end surface 51A of the bottle cap 51 of the toner cartridge, as shown in FIG. 11. In this case, the ID chip 32 is held in the longitudinal direction on the end surface 51A.

As for a holding member, a set of pins 52, 53 are arrayed and provided in the end surface 51A vertically. As shown in FIG. 12A, when the ID chip 32 is set to the end surface 51A, the pins 52, 53 are fitted into the concave portions 41, 42 of the ID chip 32, respectively, which allows the holding member to grip and hold the ID chip 32.

After being held, the ID chip 32 moves downward due to self weight, so that the inner periphery portion of the concave portion 42 contacts the pin 53 (more specifically, the outer periphery surface of a pin body 53A), and space is left between the inner periphery portion of the concave portion 41 and the pin 52 (more specifically, the outer periphery surface of a pin body 52A).

The pin 52 has the pin body 52A formed of a small pillar and a pin head 52B formed of a disk. The pin head 52B is provided in the edge section of the pin body 52A.

The pin 53 has the pin body 53A formed of a small pillar and a pin head 53B formed of a disk. The pin head 53B is provided in the edge section of the pin body 53A.

The half diameter of the pin head 52B of the pin 52 is set slightly larger than that of the concave portion 41 of the ID chip 32, so that the outer periphery portion of the pin head 52B is positioned at the outer of the inner periphery portion of the concave portion 41, as shown in FIG. 12A, when the ID chip 32 is set to the end surface 51A.

The half diameter of the pin head 53B of the pin 53 is set slightly larger than that of the concave portion 42 of the ID chip 32, so that the outer periphery portion of the pin head 53B is positioned at the outer of the inner periphery portion of the concave portion 42, as shown in FIG. 12A, when the ID chip 32 is set to the end surface 51A.

The half diameter of the pin head 53B of the pin 53 is set slightly larger than that of the concave portions 42 of the ID chip 32, so that the outer periphery portion of the pin head 53B is positioned at the outer of the inner periphery portion of the concave portion 42, as shown in FIG. 12A, when the ID chip 32 is set to the end surface 51A.

With the constitution above, even if the ID chip 32 is vibrated and so on for some reason, it is possible to reliably prevent the ID chip 32 from being removed from the end surface 51A.

The distance between the outer periphery surfaces of the pin bodies 52A, 53A of the pins 52, 53 is slightly larger than the minimum width of the ID chip 32 (distance between innermost of inner periphery portions of the Concave portions 41, 42), so that the ID chip 32 is held onto the bottle cap 51 in a condition to rattle (in other words, the ID chip 32 is held by the bottle cap 51 so that it is able to move but not to drop out) when the ID chip 32 is set to the end surface 51A.

Therefore, when a plurality of the pin electrodes 34-36 begin to contact the through-hole electrodes 45, 46A, 47A, the through-hole electrodes 45, 46A, 47A move to change their position along with the pin electrodes 34-36; therefore, it is possible to set the ID chip 32 smoothly.

Embodiment 7

Figure 13:
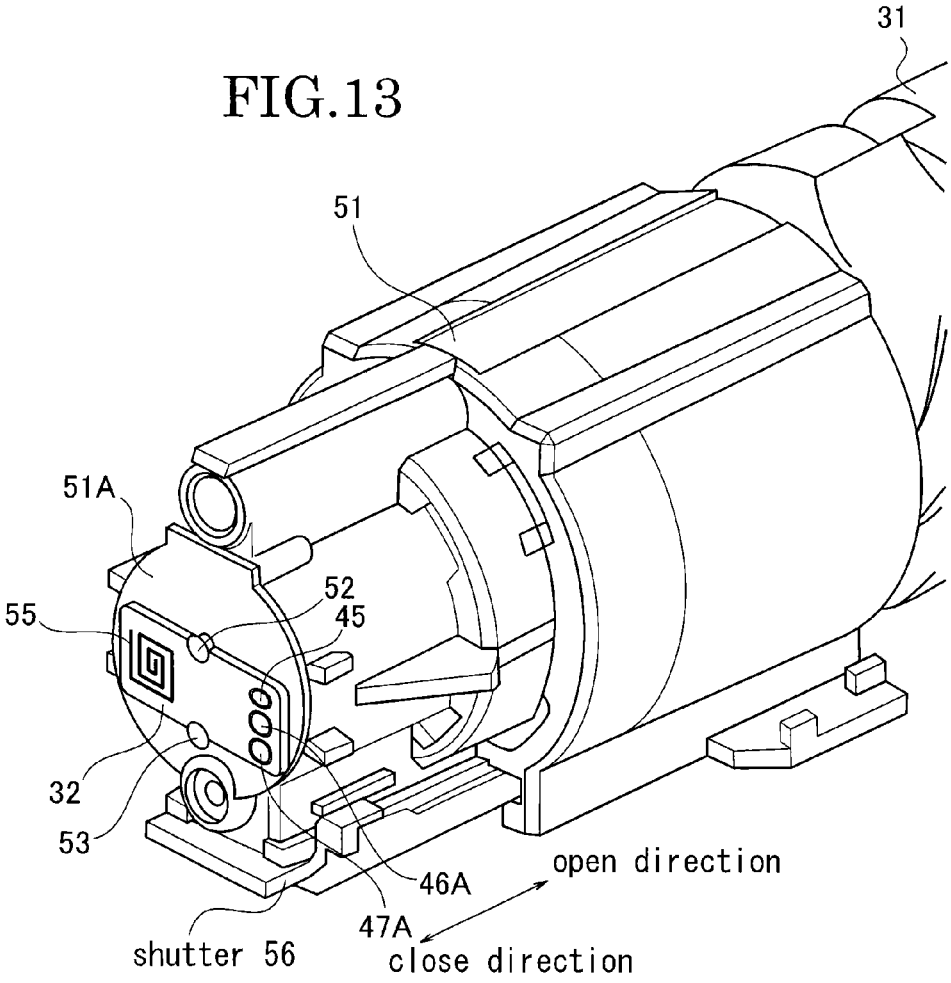
FIG. 13 is a perspective view showing an ID chip attached to the tip of the bottle cap of a toner cartridge according to Embodiment 7.
Figure 14:
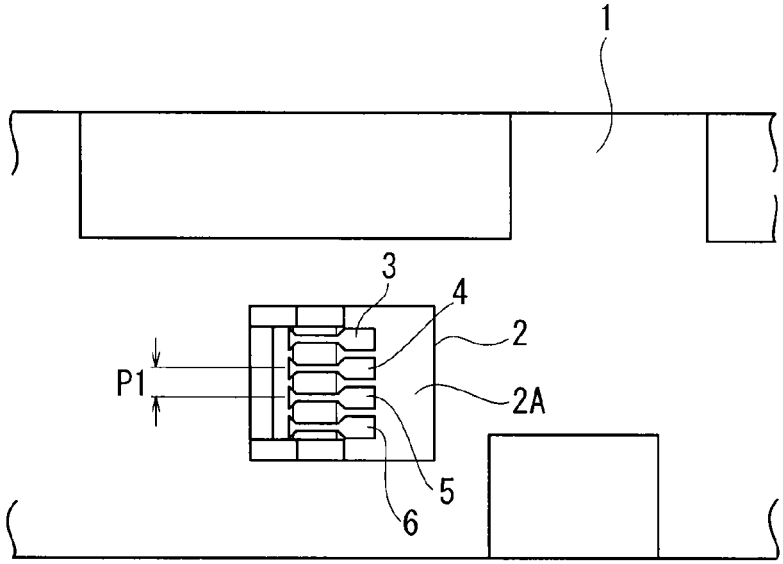
FIG. 14 shows a plan view of the substrate on the side of the body of the image-forming apparatus according to the related art.
Figure 15:
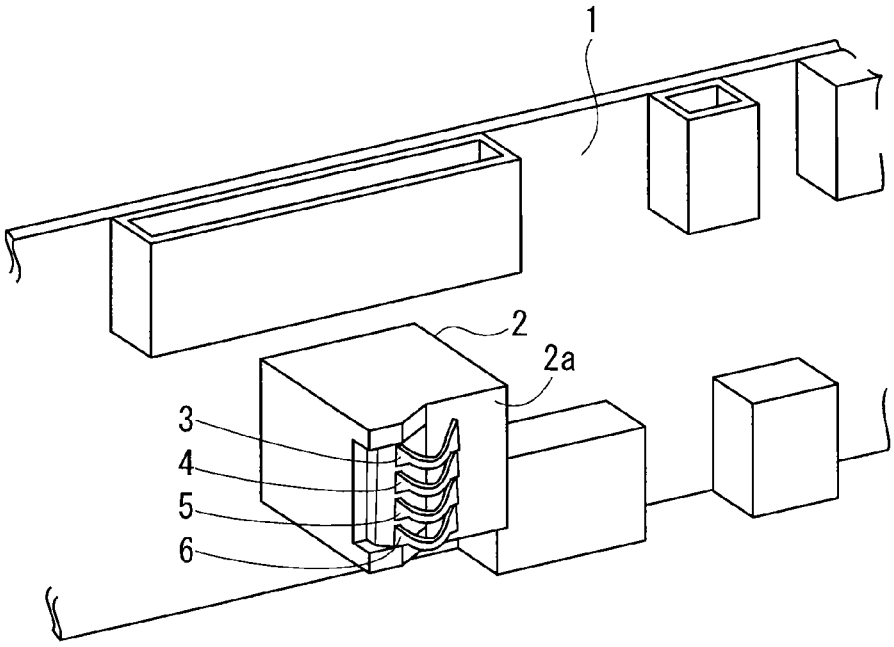
RELATED ART FIG.15
FIG. 15 shows a perspective view of the substrate shown in FIG. 14.
Figure 16:
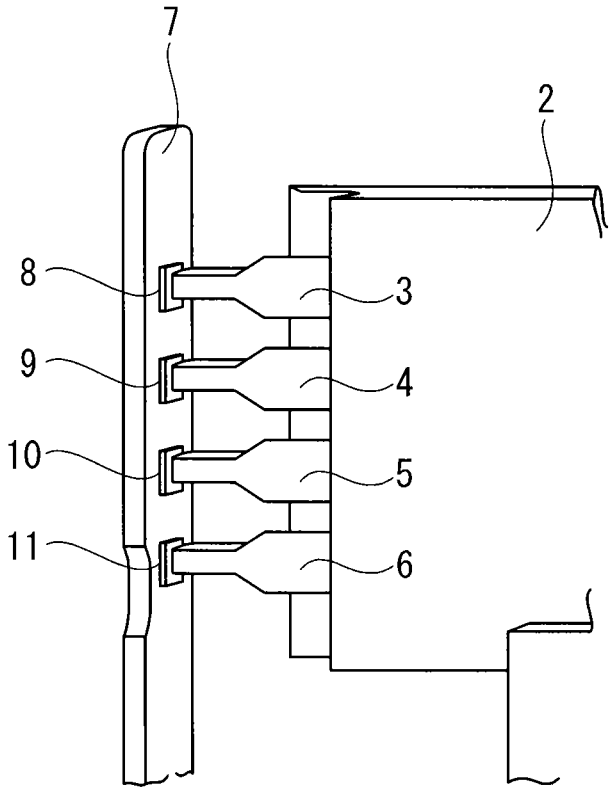
FIG. 16 is a perspective view showing a relationship of the pin electrodes and electrodes on the ID chip according to the related art.

FIG. 13 shows Embodiment 7. In Embodiment 7, the non-contact-type communication unit 55 shown in Embodiment 3 is provided in the ID chip 32 shown in Embodiment 5, and this ID chip 32 is attached to the tip of the bottle cap 51. The other constitutions are the same as Embodiment 6.

According to Embodiment 7, as is the case in Embodiment 3, with the contact-type and noncontact-type communication units, it is possible to carry out communication inside of the body of the image-forming apparatus 20 at less cost by the contact-type communication.

It is also possible to carry out a noncontact type communication easily in a case of collecting information of the ID chip 32 from the toner cartridge 30 at the time of manufacture of a new toner cartridge 30 or recovery of an old toner cartridge 30.

Although Embodiments 1-7 according to the present invention have been explained by referring to FIGS. 1-13, these embodiments are only illustrative of the present invention, and the present invention is not limited to the embodiments above. It is obviously acceptable to apply any modification that does not deviate from the gist of the invention.

For example, in each of the embodiments, the through-hole electrodes are provided in the ID chip 32, and the pin electrodes are provided in the substrate 33, in contrast, it is acceptable to provide the pin electrodes in the ID chip 32 and provide the through-hole electrodes in the substrate 33.

It is also possible to apply the toner cartridge 30 in the embodiments above to the developing apparatus 24 with a toner housing section (see FIG. 1). In this case, it is possible to determine the time for replacement of the developing apparatus 24 by letting the ID chip 32 memorize information (run time, residual lifetime, and so on) of the developing apparatus 24 besides the information of the toner cartridge 30. In addition, it is possible to detect and determine an abnormality of the developing apparatus 24 by letting the ID chip 32 memorize information which is needed for controlling and by using this information for the detection and determination.

According to the present invention, it is possible to provide an image-forming apparatus and installation structure for a toner container used in the image-forming apparatus in order to accomplish much more highly accurate positioning of the toner container even if the pin-pitch is narrowed down and the area of the electrodes on the ID chip is reduced.

With the configuration above, by just fitting the pin electrodes of the fitting section for the cartridge on the side of the body of the image-forming apparatus into the through-hole electrodes formed on the ID chip on the side of the toner cartridge, it is possible to electrically contact the through-hole electrodes with the pin electrodes easily and communicate between the toner container and the body of the image-forming apparatus.

The pin electrodes are fitted into the through-hole electrodes, so shat it is easy to perform the positioning of the toner cartridge relative to the body of the image-forming apparatus.

What is claimed is:

1. An image-forming apparatus, comprising:

a toner container, having a toner container body, attached to a fitting section in a body of the image-forming apparatus in a detachable manner;

a latent image-bearing member to have a latent image formed thereon;

a developer for developing the latent image with a toner supplied from the toner container body;

a substrate of the toner container having a plurality of through-hole electrodes, the through-hole electrodes include holes through the substrate of the toner container; and a substrate of the fitting section, having a plurality of pin electrodes, wherein the pin electrodes are within the through-hole electrodes when the toner container is attached to the fitting section, wherein the substrate of the toner container is movable in vertical and horizontal directions which are both perpendicular to a horizontal mounting direction of the toner container and simultaneously secured to the toner container to prevent removal of the substrate from the toner container, wherein the substrate of the toner container which includes the through-hole electrodes includes a memory to store information of the toner container.

2. The image-forming apparatus according to claim 1, wherein at least one recess is included in the substrate of the toner container for positioning and securing the substrate of the toner container using a corresponding at least one pin of the toner container such that the interaction of the at least one pin and the at least one recess prevents the removal of the substrate from the toner container, and a clearance exists between the at least one pin and the at least one recess.

3. The image-forming apparatus according to claim 1, wherein at least one of the plurality of through-hole electrodes includes a true circle shape and the other through hole electrode includes an oval or elongated shape.

4. The image-forming apparatus according to claim 1, wherein:

among the plurality of through-hole electrodes, at least one through-hole electrode includes a true circle shape, and at least another one of the through-hole electrodes includes an oval or elongated shape, and among the plurality of pin electrodes, at least one pin electrode, as many as the through-hole electrodes with a true circle shape, includes a cross sectional surface including a true circle shape, and the other pin electrode (s), as many as the through-hole electrodes with a true oval or elongated shape, include a cross-sectional surface including the oval or elongated shape.

5. The image-forming apparatus according to claim 1, wherein the pin electrodes include a shape with an edge section being tapered.

6. The image-forming apparatus according to claim 1, wherein the substrate of the toner container includes a noncontact-type communication region to perform noncontact communication with a device of the substrate of the fitting section.

7. The image forming apparatus according to claim 1, wherein:

the substrate of the toner container faces the horizontal mounting direction of the toner container into the image-forming apparatus.

8. The image forming apparatus according to claim 1, wherein:

a face of the substrate of the toner container, when the toner container is mounted to the image forming apparatus, faces a direction which is parallel to a horizontal direction, relative to an orientation of the image-forming apparatus during use.

9. An installation structure, comprising:

a toner container, having a toner container body, attached to a fitting section in a detachably manner and for use in a body of an image-forming apparatus;

a substrate of the toner container having a plurality of through-hole electrodes, the through-hole electrodes include holes through the substrate of the toner container; and a substrate of the fitting section, having a plurality of pin electrodes, wherein the pin electrodes are within the through-hole electrodes when the toner container is attached to the fitting section, wherein the substrate of the toner container is movable in vertical and horizontal directions which are both perpendicular to a horizontal mounting direction of the toner container and simultaneously secured to the toner container to prevent removal of the substrate from the toner container, wherein the substrate of the toner container which includes the through-hole electrodes includes a memory to store information of the toner container.

10. A toner container comprising:

a toner container body including therein toner; and a substrate including a plurality of through-hole electrodes, the substrate being movable in vertical and horizontal directions which are both perpendicular to a horizontal mounting direction of the toner container and simultaneously secured to the toner container to prevent removal of the substrate from the toner container, the through-hole electrodes include holes through the substrate of the toner container, wherein when the toner container is attached to an image-forming apparatus, the through-hole electrodes have disposed therein pin electrodes of the image-forming apparatus, wherein the substrate of the toner container which includes the through-hole electrodes includes a memory to store information of the toner container.

11. The toner container according to claim 10, wherein at least one recess is included in the substrate for positioning and securing the substrate using a corresponding at least one pin of the toner container such that the interaction of the at least one pin and the at least one recess prevents the removal of the substrate from the toner container, and a clearance exists between the at least one pin and the at least one recess.

12. The toner container according to claim 10, wherein at least one of the through-hole electrodes includes a true circle shape, and at least another through-hole electrode includes an oval or elongated shape.

13. The toner container according to claim 12, wherein the through-hole electrodes in the true circle shape capable of being fitted into by one of the pin electrodes in the image-forming apparatus, the cross sectional shape of the pin electrode including a true circle shape, and wherein the through-hole electrodes including the oval or elongated shape are capable of being fitted into by pin electrodes in the image-forming apparatus, the cross sectional shape of the pin electrodes including the oval or elongated circle shape.

14. The toner container according to claim 10, wherein the toner container body includes a bottle with an opening at one end, the toner container further comprising:

a cap for covering the opening, including a toner outlet to be communicated with a toner conveyance passage of a main body of the image-forming apparatus;

a shutter to open/close the toner outlet; and the substrate.

15. The toner container according to claim 14, wherein at least one recess is included in the substrate for positioning and securing the substrate using a corresponding at least one pin of the toner container such that the interaction of the at least one pin and the at least one substrate prevents the removal of the substrate from the toner container, and a clearance exists between the at least one pin and the at least one recess.

16. The toner container according to claim 14, wherein at least one of the through-hole electrodes includes a true circle shape, and at least another one of the through-hole electrodes includes an oval or elongated shape.

17. The toner container according to claim 16, wherein:

the at least one through-hole electrode including the true circle shape is capable of being fitted into by one of the pin electrodes in the image-forming apparatus, the cross sectional shape of the pin-electrode being the true circle shape, and the at least another one of the through-hole electrodes including the oval or elongated shape is capable of being fitted into by at least another pin electrode in the image-forming apparatus which has a cross sectional shape which is the oval or elongated circle shape.

18. The toner container according to claim 10, wherein:

the substrate of the toner container faces the horizontal mounting direction of the toner container into the image-forming apparatus.

19. The toner container according to claim 10, wherein:

a face of the substrate, when the toner container is mounted to the image forming apparatus, faces a direction which is parallel to a horizontal direction, relative to an orientation of the image-forming apparatus during use.

* * * * *